United States Patent [19]

Latimer

[11] 4,288,949

[45] Sep. 15, 1981

[54] MODULAR GARAGE STRUCTURE

[76] Inventor: John Latimer, 903 S. Ashland, Apt. 1007-B, Chicago, Ill. 60607

[21] Appl. No.: 58,722

[22] Filed: Jul. 18, 1979

[51] Int. Cl.[3] ..... E04B 1/343; E04H 6/04

[52] U.S. Cl. ..... 52/67

[58] Field of Search ..... 52/64, 66, 67

[56] References Cited

U.S. PATENT DOCUMENTS

| | | | |
|---|---|---|---|
| 1,456,478 | 5/1923 | White | 52/67 |
| 1,572,790 | 2/1926 | Grigsby | 52/66 |
| 1,896,433 | 2/1933 | Windeknecht | 52/67 |
| 2,789,668 | 4/1957 | Martin | 52/67 |
| 3,465,765 | 9/1969 | Dietz | 52/67 |
| 4,150,682 | 4/1979 | Ryce | 135/4 R |

FOREIGN PATENT DOCUMENTS

| | | | |
|---|---|---|---|
| 1059516 | 10/1953 | France | 52/67 |
| 332069 | 2/1959 | Switzerland | 52/67 |
| 335187 | 9/1930 | United Kingdom . | |
| 376379 | 7/1932 | United Kingdom . | |

*Primary Examiner*—James L. Ridgill

*Attorney, Agent, or Firm*—Kirk M. McInerney

[57] ABSTRACT

A modular garage structure is disclosed which provides an easily transportable, tamper proof housing for vehicles. Two housing enclosures are telescopically movable along a track to permit the garage to be longitudinally opened and closed.

2 Claims, 8 Drawing Figures

MODULAR GARAGE STRUCTURE

BACKGROUND OF THE INVENTION

This invention relates generally to improvements in garage structures and particularly to modular garages for vehicles such as automobiles, trucks, motorcycles and similar vehicles.

Several modular vehicle structures are known in the art. These have been constructed of hinged structures having flexible or fabric coverings for protection from the elements. Those prior art structures were not tamper proof however. Other garage structures proposed in the prior art have been costly and permanent structures.

There is a need for a low cost modular garage structure which serves to protect an enclosed vehicle from the elements and from vandals or thieves, which is of low cost to manufacture and easily transportable.

OBJECTS OF THE INVENTION

It is a general object of this invention to provide an improved modular garage for vehicles.

It is another object of the invention to provide a modular garage of rigid material which can be securely anchored in one location to protect the vehicle from the elements and intruders.

Still another object of the invention is to provide a modular garage which is easily transportable from location to location in a unitary assembly.

SUMMARY OF THE INVENTION

The present invention provides a modular garage having two telescopically movable enclosure members. The enclosures are contoured to receive a particular vehicle, such as an automobile and one of the members has a cross section dimension slightly larger than the other member to permit relative telescopic movement of at least one of the members along a longitudinal track. The garage is opened by sliding one member over the other to permit entry of the vehicle and is closed by opposite movement to a point where the members are only slightly overlapping.

Intruders are prevented from tampering with the enclosed vehicle. The present invention is economical to manufacture and can be easily transported thereby being particularly attractive to those individuals who do not have access to a permanent, conventional garage structure in which to park their vehicles.

BRIEF DESCRIPTION OF THE FIGURES

The above and other objects of the invention are more particularly set forth in the following detailed description and in the accompanying drawings of which.

Figure 1:
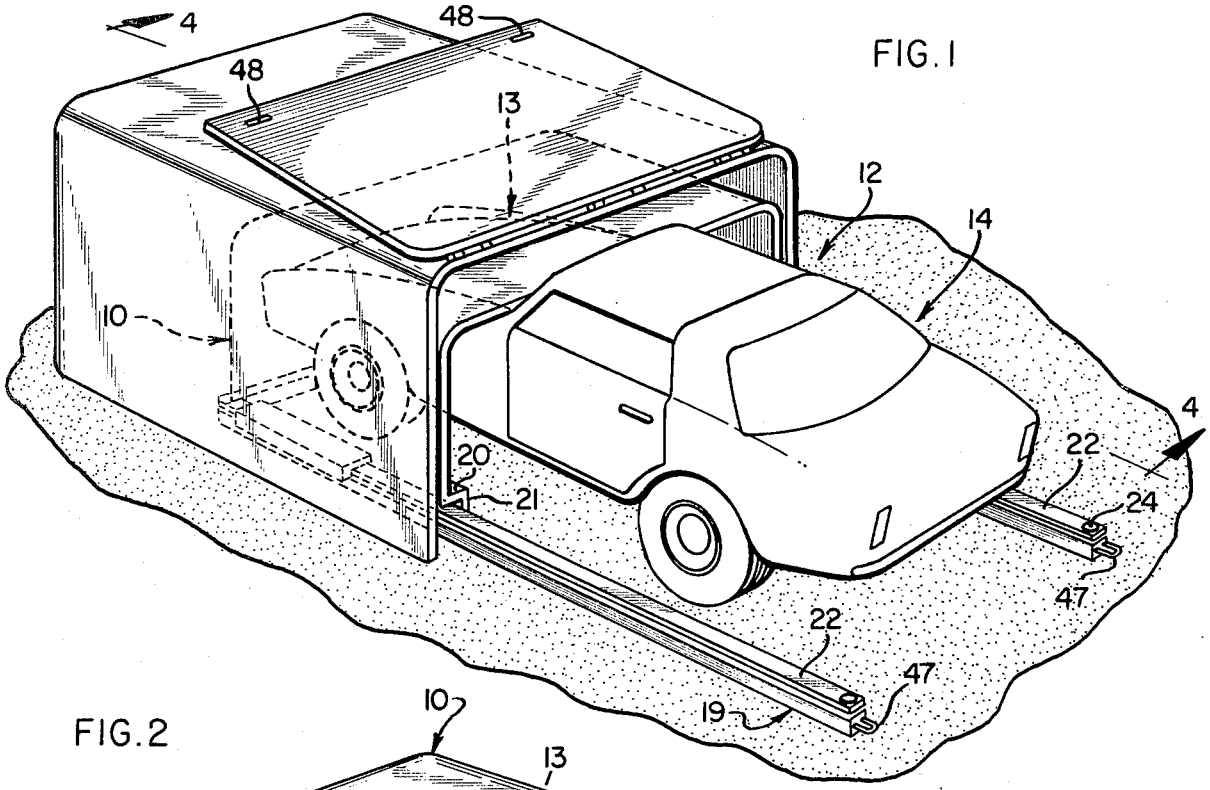
FIG. 1 is a perspective view of an embodiment of the invention shown in the open position with a vehicle inserted therein.
Figure 4:
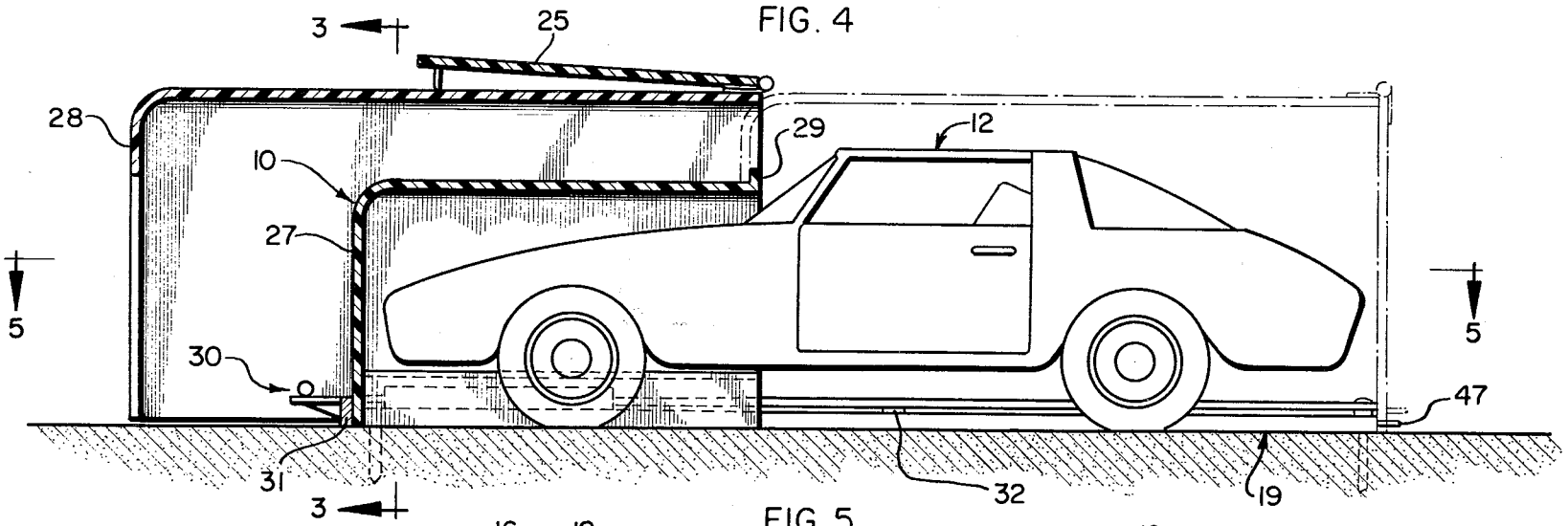
Figure 5:
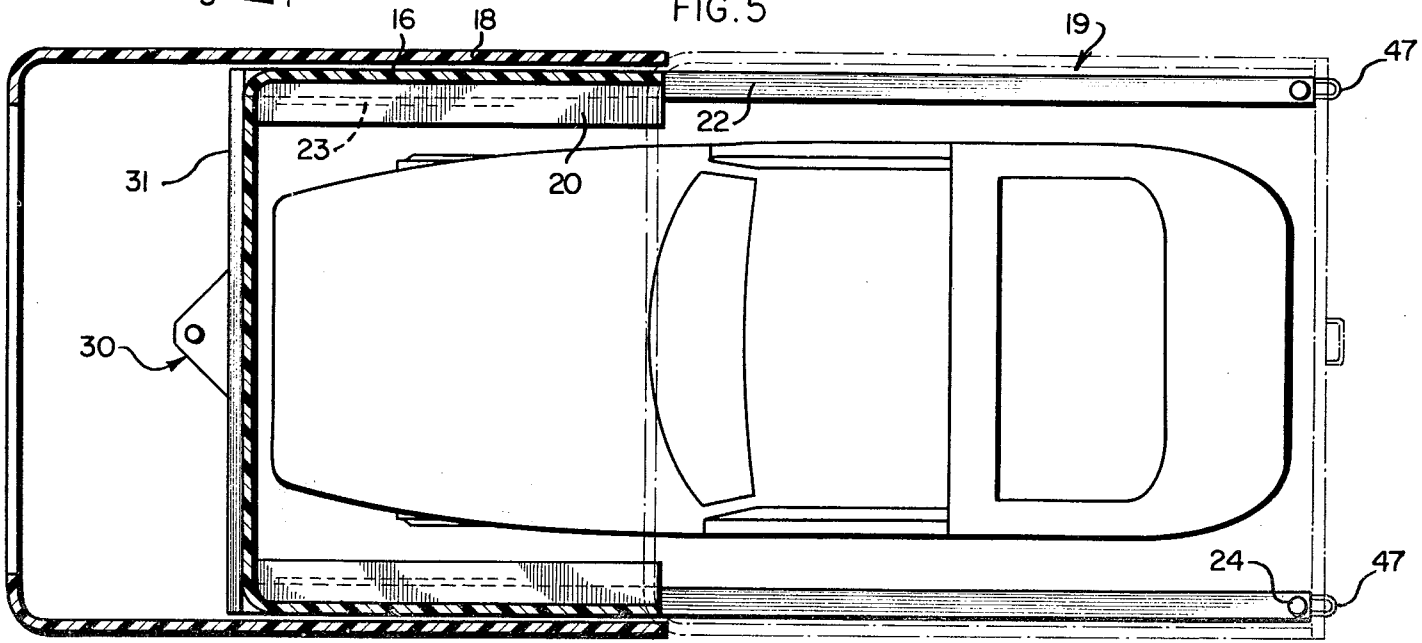
Figure 6:
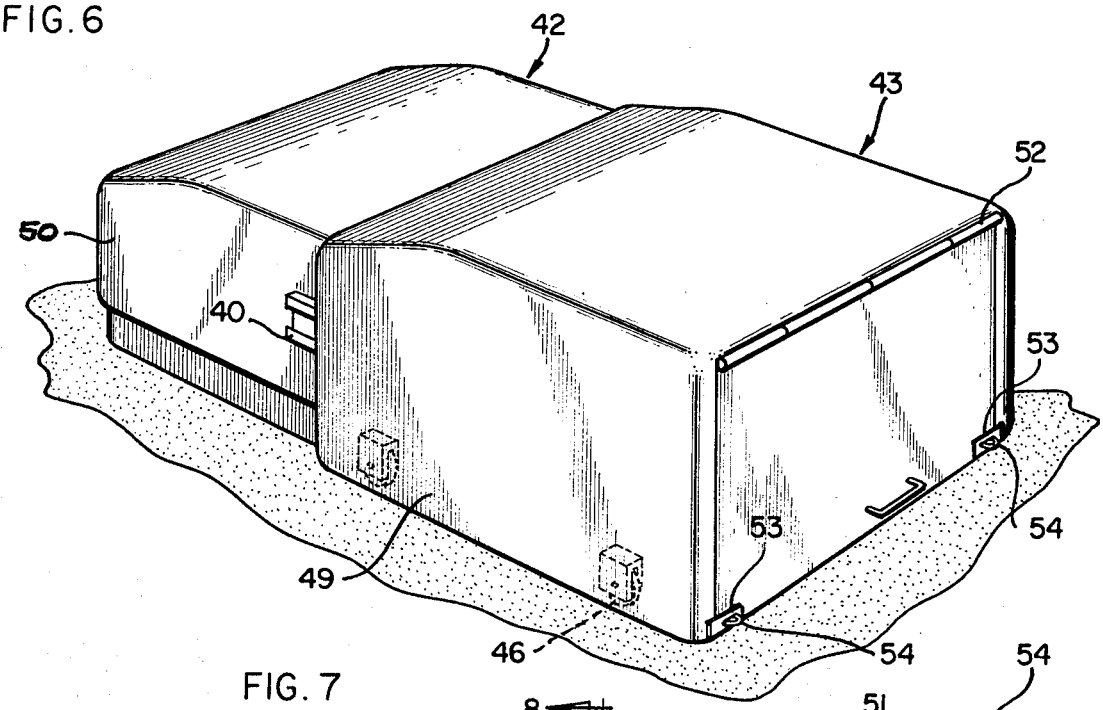
Figure 7:
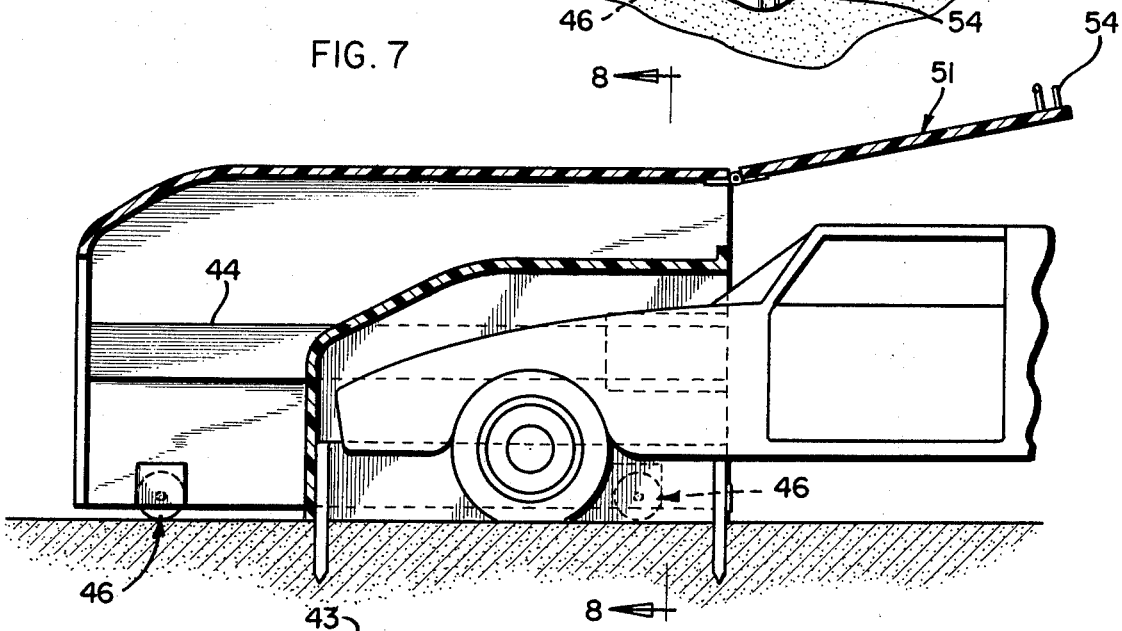
Figure 8:
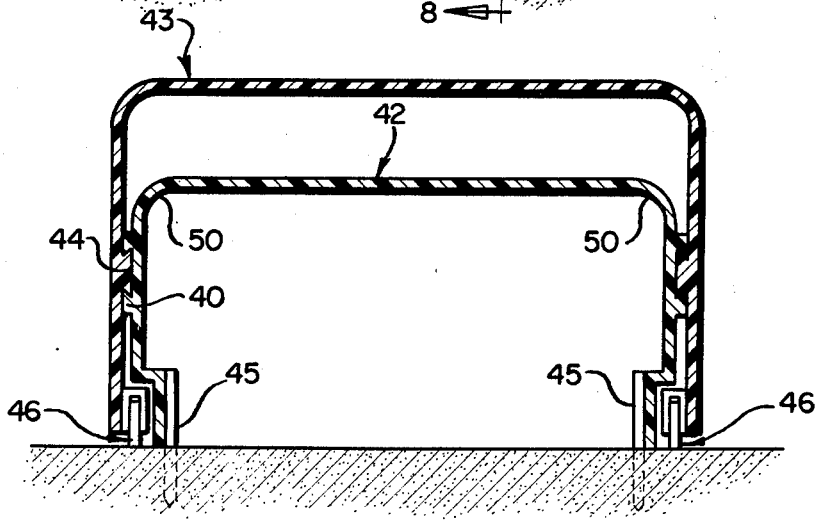

FIG, 4 is a cut away and sectional view of FIG. 1 along line 4—4;

FIG. 5 is a cut away, top view of FIG. 4 along line 5—5;

FIG. 6 is a perspective view of another embodiment of the invention in the closed position;

FIG. 7 is a cross sectional cut away side view of the embodiment shown in FIG. 6 in the open position with a vehicle therein; and FIG. 8 is an end view of the embodiment shown in FIG. 7 without the vehicle along line 8—8.

DETAILED DESCRIPTION OF THE INVENTION

Figure 2:
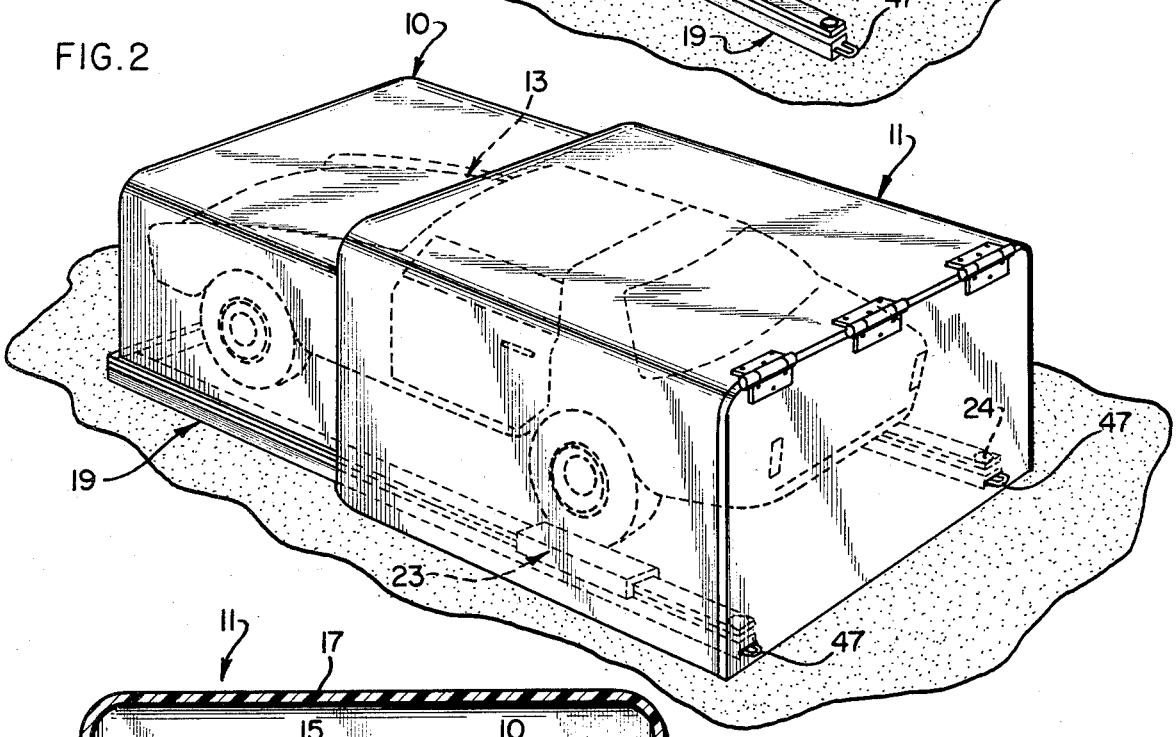
FIG. 2 is a perspective view of the embodiment shown in FIG. 1 in the closed position about the vehicle.

Similar reference to characters illustrate corresponding parts and features, and referring to FIGS. 1 and 2, there is shown an embodiment of a modular garage embodying various aspects of the invention. In the illustrated embodiment, the garage includes a first enclosure member 10 and a second enclosure member 11. An automobile 12 is included for purposes of illustrating the dimensional aspects of enclosure members 10 and 11. More specifically, the automobile 12 has a front portion 13 as defined generally from the front of the automobile to approximately the windshield and a rear portion 14 defined from the beginning of the top of canopy to the rear bumper of the car as illustrated.

Figure 3:
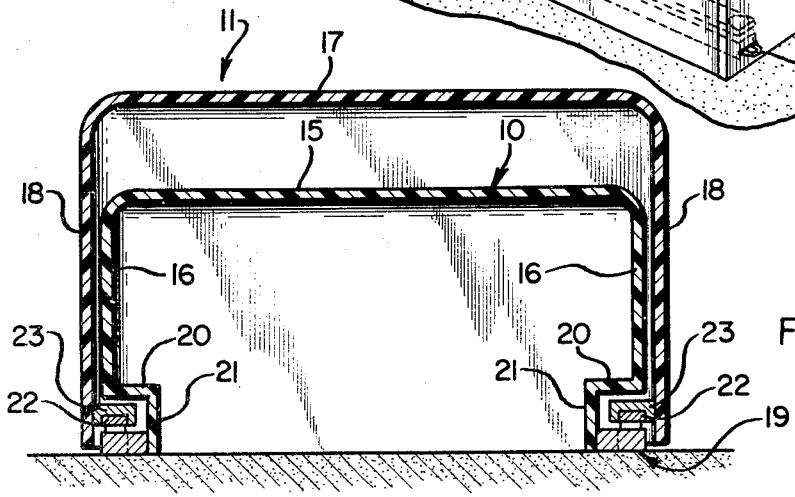
FIG. 3 is a sectional view of FIG. 4 along line 3—3.

Referring now to FIGS. 2 and 3, the enclosure member 10 has a unitary construction defined by a horizontal top wall 15 and two contoured longitudinal side walls 16 as shown. Similarly, the enclosure member 11 has a top 17 and two longitudinal side walls 18. Enclosures 10 and 11 can be contoured to fit any particular vehicle and as shown in FIGS. 1 to 5, are dimensioned for a particular class of vehicles for which the garage is intended, such as for an automibile, as illustrated.

FIG. 1 illustrates the garage in the retracted or open position wherein the enclosure 11 is positioned to substantially overlap the enclosure 10. As best shown in FIG. 3, the cross sectional configuration of the enclosure 11 is similar to and slightly larger than the cross sectional configuration of the enclosure 10 to permit an individual to open the garage to the retracted position wherein member 11 substantially overlaps member 10. As shown in FIG. 1, the front 13 of the automobile 14 is positioned within the enclosure 10 with the garage in the retracted position. With the automobile 12 positioned in the retracted garage, the driver is able to open a door of the automobile and remove himself without interference from the garage. FIG. 2 illustrates the garage shown in the extended position wherein the enclosure 11 has been longitudinally telescoped over the rear portion 14 of the automobile 12 leaving the enclosures adjacently overlapping.

As best illustrated in phantom in FIG. 4, in the extended position the enclosures 10 and 11 are adjacently overlapping at their open transverse ends. A door 25 transversely adjoining the side walls 18 of housing 11 is mounted thereto by suitable means such as hinges 26. As illustrated in FIG. 4, the enclosure 10 has a transverse contoured end wall 27 adjoining its top and side walls at one end. Housing 10 is open at the transverse end opposite to the end wall 27 to permit entry of the automobile 12. As shown, the housing 11 is provided with a lip 28 at the transverse end opposite to door 25. In the closed or extended position of the garage as shown, the lip 28 abuts a suitable stop 29 proximately positioned near the transverse open end of housing 10.

According to one aspect of the invention as illustrated in the embodiment of FIGS. 1 to 5, a base plate 19 is provided. In this embodiment, the enclosure 10 is suitably mounted to the base plate 19 and thereby held in a stationary position relative to the enclosure 11. More specifically, the enclosure 10 is shown appropriately configured along the lower portion of its longitudinal side 16 with longitudinally and horizontally projecting walls 20 and vertically projecting longitudinal walls 21 dimensioned to accomodate the mounting of the base plate 19 and to permit movement of the enclosure 11 by a longitudinal track. The longitudinal track includes longitudinal guide rails 22 mounted on either or both sides of the base plate 19. Slide members 23 are suitably mounted to the walls 18 of the enclosure 11 to slidably cooperate with the guide rails 22 as illustrated. As will be readily apparent, a variety of guide rails 22 and slide members 23 can be employed in the present invention such as a channel shaped member cooperating with rollers or the like.

The garage as illustrated in FIG. 1–5 is securely fastened to the ground in a fixed location by securing the base plate 19 with appropriate means, such as spikes 24 securely driven into the ground. The garage shown in FIGS. 1–5 can be sealed in its extended position when the lip 28 abuts the stop 29 of the adjacently overlapping enclosures 11 and 10 by closing the door 25 and locking the same by suitable means. As will be apparent, numerous examples of locking means such as eye bolts 47 secured to the base plate 19 to cooperate with corresponding slots 48 in the door 25 could be provided to render the garage tamper proof.

According to another aspect of the invention shown in FIG. 4, a trailer hitch 30 mounted to a transverse plate 31 securely fastened to the end wall 27 of enclosure 10 is provided. The base plate 19 is provided with an axle hub 32 through which can be mounted a suitable wheel and axle assembly (not shown) to permit the transportation of the garage unit to another location by removing the spikes 24, adding wheels and axle, and trailering the garage by hitch 30.

The present invention as shown in FIGS. 6 to 8, provides a guide rail 44 which is centrally mounted to the interior of a longitudinal side wall 49 of a housing enclosure 43. A slide member 40 is mounted on a longitudinal side 50 of a housing enclosure 42 to slidably cooperate with the guide rail 44. FIG. 8 illustrates a dove tail slot for elements 40 and 44 which are integrally molded with the enclosures 42 and 43. As will be apparent, any suitable guide means may be employed in place of the dove tail slot for elements 40 and 44, such as a channel and cooperating rollers.

According to another aspect of the invention shown in FIGS. 6 to 8, in place of the base plate described above there is provided a securing means such as spikes 45 to anchor the enclosure 42 securely to the ground. The enclosure 43 is suitably provided with a set of wheels 46 to facilitate telescopic movement of structure 43 from the retracted position of FIG. 7 to the extended position of FIG. 6. A door 51 and hinges 52 transversely adjoining walls 50 and 49 are provided with suitable locking means such as a bracket 53 cooperating with an eye bolt 54 to securely close the door 51. The operational details of this embodiment are similar to the embodiment of FIGS. 1 to 5 described above.

Operationally, the present invention permits the front of a vehicle to be driven or positioned in the garage when the second enclosure member, with its door open, is retracted over the first enclosure. The driver then exits the vehicle and slides the second enclosure over the rear of the vehicle, and closes and secures the door.

From the above description of the various embodiments, it will be apparent that the present invention provides a portable, modular garage which can enclose a vehicle to prevent intrusion by the elements and thieves. The enclosure members are easily manufactured from rigid materials as a moldable plastic, fiberglass or like materials.

Other embodiments of the present invention could include enclosure members which are less contoured and which have more equal cross sectional dimensions to provide variety for the types and/or sizes of vehicles which could be enclosed therein. Furthermore, transverse doors could be provided at both of the extreme ends of the enclosure members to provide for entering the garage by either backing the vehicle therein or, as described above, by positioning the front of the vehicle therein.

Although the invention has been described in terms of specific preferred structures, it will be obvious to one skilled in the art that numerous modifications are contemplated by the invention disclosed herein and that all such modifications and alterations be included within the scope of the invention as defined in the appended claims.

What is claimed is:

1. A garage for a vehicle having a front end and a rear end comprising:

a two piece contoured structure having a first stationary enclosure member and a second movable enclosure member;

said first stationary enclosure member having a top and two longitudinal contoured sidewalls and a transverse contoured end wall adjoining said sidewalls, said first member being open at one transverse end and cross-sectionally and longitudinally dimensioned to receive the front of the vehicle;

said second contoured enclosure member having a top and two longitudinal sidewalls being open at both transverse ends, and having a slightly larger cross-sectional dimension than said first member;

a U-shaped base plate having two longitudinal extensions projecting along the sidewalls and beyond the open transverse end of said first member to serve as a frame work for transporting the garage from location to location and further having means for anchoring the base plate to the ground in a fixed location;

track members carried by the extensions of said base plate and slide members connected to said second member and mounted on said track members slidably connecting the second member to the first member so that an operator can manually slide the second member from a retracted position in which the first and second enclosure members are substantially overlapping to permit ingress and egress of the vehicle, to an extended position in which the second member is adjacent to the first member thereby completely enclosing the vehicle; and a door adjoining the longitudinal sides of the second enclosure member which can be opened to admit the vehicle when said enclosure members are retracted and closed with the members in the extended position.

2. The garage according to claim 1 wherein the garage further includes:

a trailer hitch secured to said base plate and projecting from the end wall of said first member; and means for mounting an axle and wheels to said base plate so that the garage may be readily transported to another location by mounting the axle and wheels wherein said base plate supports said first and second members off the ground permitting the garage to be transported to another location by said trailer hitch.

* * * * *